US011404784B2

(12) United States Patent
Hallivuori

(10) Patent No.: US 11,404,784 B2
(45) Date of Patent: Aug. 2, 2022

(54) MULTI-BAND ANTENNA AND COMPONENTS OF MULTI-BAND ANTENNA

(71) Applicant: NOKIA SOLUTIONS AND NETWORKS OY, Espoo (FI)

(72) Inventor: Juha Hallivuori, Tampere (FI)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 140 days.

(21) Appl. No.: 16/685,438

(22) Filed: Nov. 15, 2019

(65) Prior Publication Data

US 2020/0194889 A1 Jun. 18, 2020

(30) Foreign Application Priority Data

Dec. 12, 2018 (EP) ..... 18211918

(51) Int. Cl.
*H01Q 5/00* (2015.01)
*H01Q 5/307* (2015.01)
(Continued)

(52) U.S. Cl.
CPC ..... *H01Q 5/307* (2015.01); *H01Q 1/38* (2013.01); *H01Q 1/48* (2013.01)

(58) Field of Classification Search
CPC ..... H01Q 5/307; H01Q 1/38; H01Q 1/48; H01Q 21/24; H01Q 9/0435; H01Q 9/0457;
(Continued)

(56) References Cited

U.S. PATENT DOCUMENTS

2005/0116862 A1 6/2005 du Toit
2005/0134508 A1* 6/2005 Ueda ..... H01Q 9/0464 343/700 MS
(Continued)

FOREIGN PATENT DOCUMENTS

EP 1 465 291 A1 10/2004
EP 2 159 878 A1 3/2010
WO WO 2017/100126 A1 6/2017

OTHER PUBLICATIONS

Extended European Search Report for Application No. 1/211918.0 dated Jun. 5, 2019, 11 pages.
(Continued)

*Primary Examiner* — David E Lotter
(74) *Attorney, Agent, or Firm* — Alston & Bird LLP

(57) ABSTRACT

A multi-band antenna is provided that includes a ground plane, a first lower frequency antenna radiator including one or more outer conductive elements surrounding an interior void and a first higher frequency antenna radiator including one or more interior conductive elements surrounded by an exterior void. The multi-band antenna also includes a first lower frequency antenna feed including one or more outer conductive elements surrounding at least partially an interior void and a first higher frequency antenna feed including one or more interior conductive elements surrounded at least partially by an exterior void. The multi-band antenna further includes at least one lower frequency interface and at least one higher frequency interface. The at least one lower frequency interface is for the first lower frequency feed and the at least one higher frequency interface is for the higher frequency feed.

20 Claims, 5 Drawing Sheets

(51) Int. Cl.
*H01Q 1/38* (2006.01)
*H01Q 1/48* (2006.01)

(58) Field of Classification Search
CPC ..... H01Q 21/065; H01Q 9/0414; H01Q 5/40; H01Q 5/50; H01Q 9/0464
See application file for complete search history.

(56) References Cited

U.S. PATENT DOCUMENTS

| | | | | |
|---|---|---|---|---|
| 2011/0156986 | A1 | 6/2011 | Baliarda et al. | |
| 2017/0093042 | A1 | 3/2017 | McMichael et al. | |
| 2020/0163204 | A1* | 5/2020 | Kim ..... | H05K 1/141 |

OTHER PUBLICATIONS

Agarwal, A., *Design and Development of Stacked Microstrip Antenna Array for MIMO Applications*, Research Paper, Master of Engineering in Wireless Communications, Thapar University, Patiala (Jun. 2016) 91 pages ("SECURE" ducment—cannot send complete copy).

Han, M. et al., *Dual Polarized Array Antenna for S/X Band Active Phased Array Radar Application*, Journal of the Korean Institute of Electromagnetic Engineering and Science, vol. 10. No. 4 (Dec. 2010) 309-315.

Mao, C-X. et al., *Dual-Band Circularly Polarized Shared-Aperture Array for C-/X-Band Satellite Communications*. IEEE Transactions on Antennas and Propagation, vol. 65, No. 10 (Oct. 2017) 5171-5178.

Shafai, L. L. et al., *Dual-Band Dual-Polarized Perforated Mierostrip Antennas for SAR Applications*, IEEE Transactions on Antennas and Propagation, vol. 48, No. 1 (Jan. 2000) 58-66.

Zhu, L. el al., *A Compact Hybrid-Fed Microstrip Antenna for Harmonics-Based Radar and Sensor Systems*, IEEE Antennas and Wireless Propagation Letters, vol. 17, No. 12 (Dec. 2018); 2444-2448.

Office Action for European Application No. 18211918.0 dated Jan. 31, 2022, 10 pages.

* cited by examiner

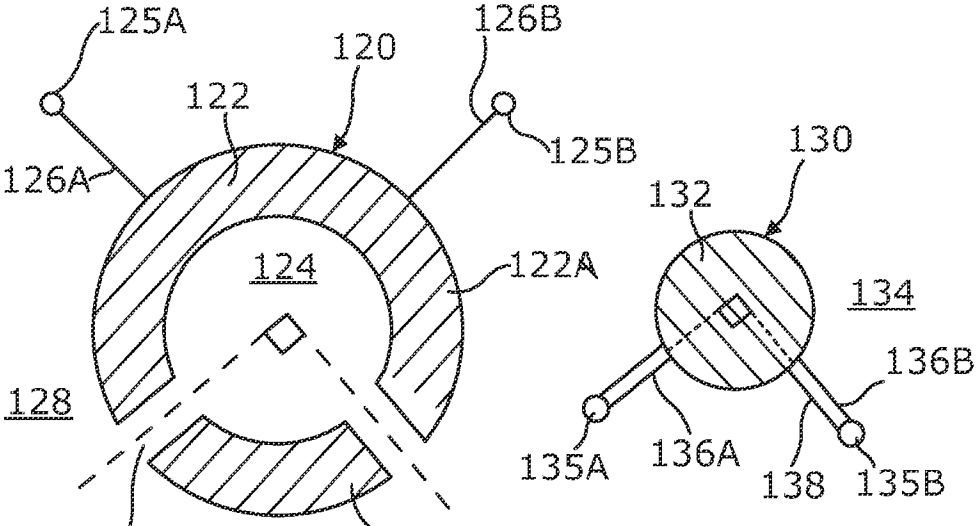
Fig. 3B
Fig. 3A
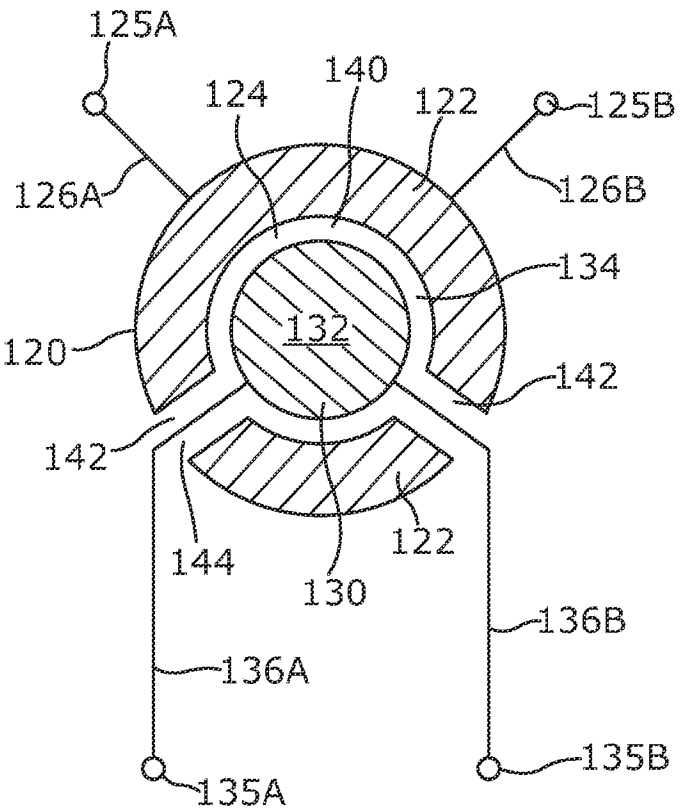
Fig. 2

MULTI-BAND ANTENNA AND COMPONENTS OF MULTI-BAND ANTENNA

CROSS-REFERENCE TO RELATED APPLICATIONS

This application claims priority to European Patent Application No. 18211918.0, filed Dec. 12, 2018, the entire contents of which are incorporated herein by reference.

TECHNOLOGICAL FIELD

Embodiments of the present disclosure relate to a multi-band antenna or components of a multi-band antenna.

BACKGROUND

A multi-band antenna has different operational frequency bands.

It can be difficult to design an apparatus that operates as a multi-band antenna and is also of compact size.

BRIEF SUMMARY

According to various, but not necessarily all, embodiments there is provided a multi-band antenna comprising:

a ground plane;

a first lower frequency antenna radiator comprising one or more outer conductive elements surrounding an interior void;

a first higher frequency antenna radiator comprising one or more interior conductive elements surrounded by an exterior void;

a first lower frequency antenna feed comprising one or more outer conductive elements surrounding at least partially an interior void;

a first higher frequency antenna feed comprising one or more interior conductive elements surrounded at least partially by an exterior void; and at least one lower frequency interface and at least one higher frequency interface, wherein the at least one lower frequency interface is for the first lower frequency feed and the at least one higher frequency interface is for the higher frequency feed.

In some but not necessarily all examples, the one or more interior conductive elements of the first higher frequency antenna feed overlap the interior void of the first lower frequency antenna feed.

In some but not necessarily all examples, the one or more interior conductive elements of the first higher frequency antenna feed are surrounded at least partially by the one or more outer conductive elements of the first lower frequency antenna feed and are separated therefrom by a portion of the interior void of the first lower frequency antenna feed that is also at least part of the exterior void of the first higher frequency antenna feed.

In some but not necessarily all examples, the one or more interior conductive elements of the first higher frequency antenna radiator overlap the interior void of the first lower frequency antenna radiator and do not overlap the one or more outer conductive elements of the first lower frequency antenna radiator.

In some but not necessarily all examples, a first printed circuit board provides the ground plane, the first lower frequency antenna feed, and the first higher frequency antenna feed, a second printed circuit board different to the first printed circuit board provides the first higher frequency antenna radiator, and a third printed circuit board, different to the first printed circuit board and the second printed circuit board, provides the first lower frequency antenna radiator.

In some but not necessarily all examples, the first lower frequency antenna feed and the first higher frequency antenna feed lie in the same plane and wherein the at least one higher frequency interface is connected to the first higher frequency antenna feed via an in-plane connector that passes through a gap between outer conductive elements of the first lower frequency antenna feed.

In some but not necessarily all examples, the one or more outer conductive elements of the first lower frequency antenna radiator are in a first plane and the one or more interior conductive elements of the first higher frequency antenna radiator are in a second plane different to the first plane and the second plane is further from the ground plane than the first plane.

In some but not necessarily all examples, the one or more outer conductive elements of the lower frequency antenna radiator, surrounded by an exterior void, define a shape that has exterior dimensions sized to cause resonance at the lower frequency.

In some but not necessarily all examples, the interior void of the lower frequency antenna radiator is circular.

In some but not necessarily all examples, a perimeter of the lower frequency antenna radiator is at least partially circular and/or wherein a perimeter of the lower frequency antenna radiator has cut-away at an edge to avoid overlap with a second higher frequency antenna radiator.

In some but not necessarily all examples, the one or more outer conductive elements of the first lower frequency antenna radiator are shaped to provide an exterior void, a second higher frequency antenna radiator comprising one or more interior conductive elements surrounded by an exterior void, wherein the one or more interior conductive elements of the second lower frequency antenna radiator overlap the shaped exterior void of the first lower frequency antenna radiator and do not overlap the one or more outer conductive elements of the first lower frequency antenna radiator.

In some but not necessarily all examples, the multi-band antenna comprises:

an array of lower frequency antenna radiators, including the first lower frequency antenna radiator, in a common plane;

an array of lower frequency antenna feeds, including the first lower frequency antenna feed;

an array of higher frequency antenna radiators, including the first higher frequency antenna radiator, in a different common plane; and an array of higher frequency antenna feeds, including the first higher frequency antenna feed, wherein the at least one lower frequency interface is for the array of lower frequency feeds and the at least one higher frequency interface is for the array of higher frequency feeds.

In some but not necessarily all examples, the array of lower frequency antenna radiators comprises multiple outer conductive elements surrounding multiple interior voids and surrounded by an exterior void, wherein the array of higher frequency antenna radiators comprises multiple interior conductive elements surrounded by an exterior void, wherein the multiple interior conductive elements of the array of higher frequency antenna radiators and the multiple outer conductive elements of the array of lower frequency antenna radiators do not overlap and wherein at least some of the multiple interior conductive elements of the array of higher frequency antenna radiators overlap the multiple interior voids of the array of lower frequency antenna radiators, wherein the other multiple interior conductive elements of the array of higher frequency antenna radiators overlap the exterior void of the array of lower frequency antenna radiators.

According to various, but not necessarily all, embodiments there is provided a planar feed for a multi-band antenna comprising:

a first lower frequency antenna feed comprising, in a plane, one or more outer conductive elements surrounding at least partially an interior void;

a first higher frequency antenna feed comprising, in the plane, one or more interior conductive elements surrounded at least partially by the interior void;

and at least one lower frequency interface and at least one higher frequency interface, wherein the at least one lower frequency interface is for the first lower frequency feed and the at least one higher frequency interface is for the first higher frequency feed.

According to various, but not necessarily all, embodiments there is provided a communications apparatus comprising radio frequency circuitry and the multi-band antenna.

According to various, but not necessarily all, embodiments there is provided examples as claimed in the appended claims.

The multi-band antenna can be of a compact size.

BRIEF DESCRIPTION

Some example embodiments will now be described with reference to the accompanying drawings in which FIG. 1 shows an example embodiment of the subject matter described herein;

FIG. 2 shows an example embodiment of the subject matter described herein;

FIG. 3A shows an example embodiment of the subject matter described herein;

FIG. 3B shows an example embodiment of the subject matter described herein;

DETAILED DESCRIPTION

Figure 1:
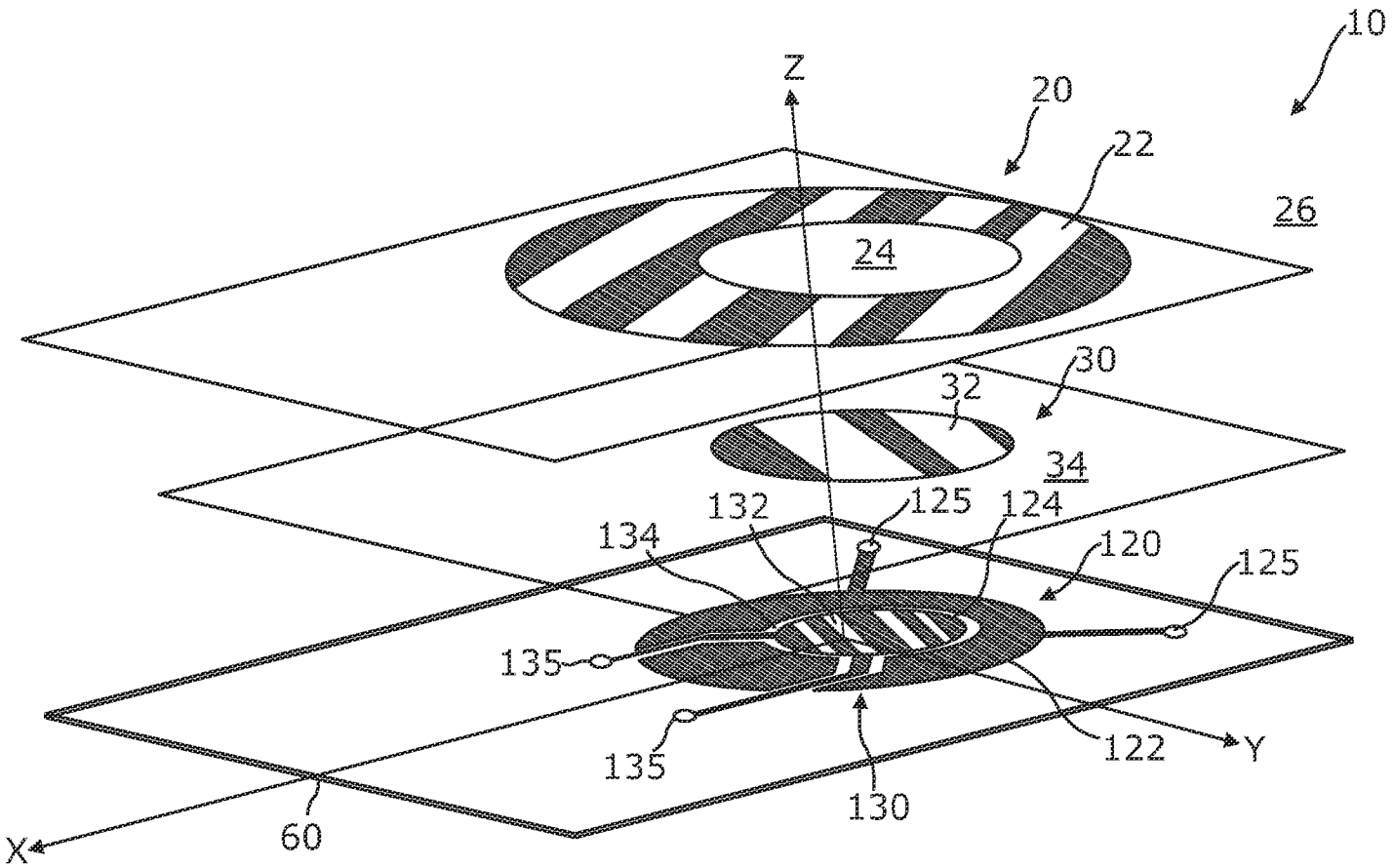

FIG. 1 illustrates an example of a multi-band antenna 10. The multi-band antenna 10 has at least a lower operational frequency band and a higher operational frequency band.

The multi-band antenna 10 comprises: a ground plane 60; a first lower frequency antenna radiator 20; a first higher frequency antenna radiator 30; a first lower frequency antenna feed 120; a first higher frequency antenna feed 130; at least one lower frequency interface 125 for the first lower frequency feed 120 and at least one higher frequency interface 135 for the first higher frequency feed 130.

The first lower frequency antenna radiator 20 comprises one or more outer conductive elements 22 surrounding an interior void 24. The first higher frequency antenna radiator 30 comprises one or more interior conductive elements 32 surrounded by an exterior void 34.

The first lower frequency antenna feed 120 comprises one or more outer conductive elements 122 surrounding at least partially an interior void 124. The first higher frequency antenna feed 130 comprises one or more interior conductive elements 132 surrounded at least partially by an exterior void 134. An example of an inter-relationship of the first lower frequency antenna feed 120 and first higher frequency antenna feed 130 is illustrated in FIG. 2. The corresponding first lower frequency antenna feed 120 is illustrated in FIG. 3A and the corresponding first higher frequency antenna feed 120 is illustrated in FIG. 3B.

The voids 24, 34, 124, 134 are defined by an absence of conductive material and the presence of dielectric, whether the dielectric is a solid dielectric material or a fluid such as an air gap.

The interior conductive element(s) 132 of the first higher frequency antenna feed 130 overlap the interior void 124 of the first lower frequency antenna feed 120. In some but not necessarily all examples, the interior conductive element(s) 132 of the first higher frequency antenna feed 130 do not overlap the one or more outer conductive elements 122 of the first lower frequency antenna feed 120. This separates the feeds in space. In other examples, the interior conductive element(s) 132 of the first higher frequency antenna feed 130 partially overlap, at a periphery, the one or more outer conductive elements 122 of the first lower frequency antenna feed 120.

The feeds 120, 130 may be in a common layer or in different planes. In the illustrated example, the feeds 120, 130 are in same plane. The one or more interior conductive elements 132 of the first higher frequency antenna feed 130 are surrounded at least partially by the one or more outer conductive elements 122 of the first lower frequency antenna feed 120 and are separated therefrom by a portion of the interior void 124 of the first lower frequency antenna feed 120 that is also at least part of the exterior void 134 of the first higher frequency antenna feed 130.

In the illustrated example, the one or more interior conductive elements 32 of the first higher frequency antenna radiator 30 overlap the interior void 124 of the first lower frequency antenna radiator 20. In this example, the one or more interior conductive elements 32 of the first higher frequency antenna radiator 30 do not overlap the one or more outer conductive elements 22 of the first lower frequency antenna radiator 20. This reduces inter-radiator coupling.

In the illustrated example, the one or more outer conductive elements 22 of the first lower frequency antenna radiator 20 overlap the outer conductive element(s) 122 of the first lower frequency antenna feed 120. In some but not necessarily all examples, the one or more outer conductive elements 22 of the first lower frequency antenna radiator 20 do not overlap the interior conductive element(s) 132 of the first higher frequency antenna feed 130. This reduces unwanted coupling. In other examples, the one or more outer conductive elements 22 of the first lower frequency antenna radiator 20 partially overlap the interior conductive element(s) 132 of the first higher frequency antenna feed 130.

In this example, the one or more outer conductive elements 22 of the first lower frequency antenna radiator 20 overlap the exterior void 34 of the first higher frequency antenna radiator 30 and do not overlap the one or more interior conductive elements 32 of the first higher frequency antenna radiator 30.

In the illustrated example, the one or more interior conductive elements 32 of the first higher frequency antenna radiator 30 overlap the interior conductive element(s) 132 of the first higher frequency antenna feed 130. In this example, the one or more interior conductive elements 32 of the first higher frequency antenna radiator 30 do not overlap the outer conductive element(s) 122 of the first lower frequency antenna feed 120. This reduces unwanted coupling. In this example, the one or more interior conductive elements 32 of the first higher frequency antenna radiator 30 overlap the interior void 24 of the first lower frequency antenna radiator 22 and do not overlap the one or more outer conductive elements 22 of the first lower frequency antenna radiator 20.

The antenna 10 is a dual-feed, compact, stacked arrangement where the radiators 20, 30 are vertically stacked but do not overlap because of one or more 'cut-out' voids in the conductive portions 22, 32 of the radiators 20, 30 and the feeds 120, 130 do not overlap because of one or more 'cut-out' voids 124 in the conductive portions 122, 132 of the feeds 120, 130.

Figure 4:
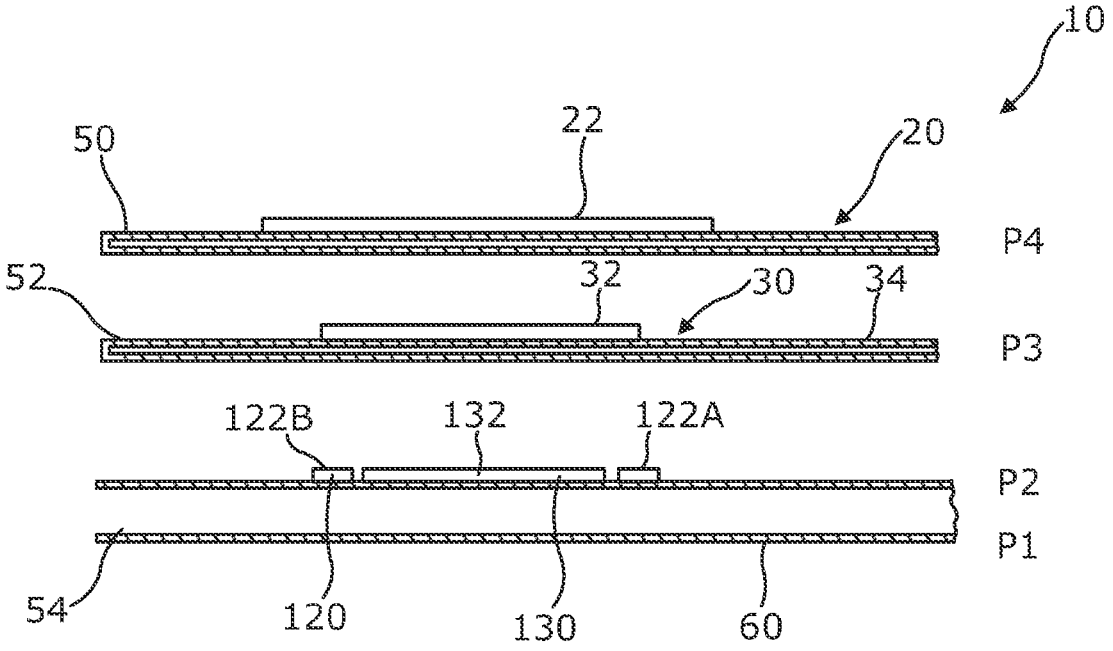
FIG. 4 shows an example embodiment of the subject matter described herein.

FIG. 4 illustrates a cross-sectional view of the apparatus 10 illustrated in FIG. 1. The ground plane 60 is in a first plane P1, the first lower frequency antenna feed 120 and the first higher frequency antenna feed 130 are in a second plane P2 (different to the first plane P1), the first higher frequency antenna radiator 30 is in a third plane P3 (different to the first plane P1 and the second plane P2), and the first lower frequency antenna radiator 20 is in a fourth plane P4 (different to the first plane P1, second plane P2 and third plane P3).

A first printed circuit board 54 provides the ground plane 60 in the first plane P1, and the first lower frequency antenna feed 120 and the first higher frequency antenna feed 130, in the second plane P2. A second printed circuit board 52 (different to the first printed circuit board 54) provides the first higher frequency antenna radiator 30, in the third plane P3. A third printed circuit board 50 (different to the first printed circuit board 54 and the second printed circuit board 52) provides the first lower frequency antenna radiator 20, in the fourth plane P4. The printed circuit boards 50, 52 and 54 are separated by dielectric, for example, dielectric material or air.

The fourth plane P4 is further from the ground plane 60 than the third plane P3. The outer conductive element(s) 22 of the first lower frequency antenna radiator 20 is further from the ground plane 60 than the interior conductive element(s) 32 of the first higher frequency antenna radiator 30.

The first lower frequency antenna feed 120 is configured to capacitively feed the first lower frequency antenna radiator 20 which operates as a patch antenna. In some examples, the lower frequency antenna feed 120 is size-matched to the lower frequency antenna radiator 20. This improves capacitive coupling.

The first higher frequency antenna feed 130 is configured to capacitively feed the first higher frequency antenna radiator 30 which operates as a patch antenna. In some examples, the higher frequency antenna feed 130 is size-matched to the higher frequency antenna radiator 30. This improves capacitive coupling.

The multi-band antenna thus comprises capacitively fed, stacked patch antennas.

In some examples, one or both of the radiators 20, 30 is provided by one or more layers of sheet metal or other conductive material (supported by solid dielectric material to suspend them at a fixed height relative to the feeds 120, 130 and ground plane 60).

The feeds 120, 130 and ground plane 60 could be provided by a RF/microwave dielectric substrate or laminate material other than FR4 (standard PCB material), for example, high dielectric Teflon/PTFE laminate. Alternatively, Ceramic Oxide materials such as: alumina or aluminum oxide (Al2O3), Sapphire, Quartz (SiO2), Zirconia, and Berylllia (BeO) could be used as a substrate. For some frequency bands one or more of the above substrates may be suitable dependent on the dielectric constant and loss tangent at frequencies within the operational frequency band and suitability may also be dependent on the RF system design requirements, both mechanical and radio frequency.

In some examples (dependent on operational frequency band(s)) some or all of P1, P2, P3 are provided using a single multi-layer printed circuit board (PCB), and in some very high frequency bands it may be possible to include also P4 in the same PCB. The thickness of the dielectric layers in the PCB could be designed to increase or decrease the dielectric layer thickness between layers. The feed conductors 122, 132 could be provided within the dielectric material of a substrate on a buried layer of etched conductive material so that they are completely surrounded by dielectric material (solid). Effectively the conductors 122, 132 would be etched onto a first dielectric solid layer and then covered by a second dielectric solid layer to bury them within the dielectric material. The top dielectric material layer could then be etched to carry the higher frequency radiator 30.

The one or more outer conductive elements 22 of the lower frequency antenna radiator 20, surrounded by an exterior void 26, define a shape that has exterior dimensions sized to cause resonance at the lower frequency. In the illustrated example, the interior void 24 of the lower frequency antenna radiator 20 is circular. A perimeter of the lower frequency antenna radiator 20 is at least partially circular. The annular (or substantially annular) outer conductive element 22 of the lower frequency antenna radiator 20, defines at least part of an annulus shape that has exterior radius sized to cause resonance at the lower frequency. The exterior radius has an electrical length (and physical length) that is approximately one half of a wavelength corresponding to the lower frequency.

The one or more interior conductive elements 32 of the higher frequency antenna radiator 30, surrounded by an exterior void 34, define a shape that has exterior dimensions sized to cause resonance at the higher frequency. In the illustrated example, the interior conductive element 32 of the higher frequency antenna radiator 30 is circular. The circular interior conductive element 32 of the higher frequency antenna radiator 30, defines a circle shape that has a radius sized to cause resonance at the higher frequency. The radius has an electrical length (and physical length) that is approximately one half of a wavelength corresponding to the higher frequency.

For example, the higher frequency may be 3.5 GHz and the lower frequency may be 1.7 GHz.

The radio frequency circuitry and the multi-band antenna 10 is configured to operate in a plurality of operational resonant frequency bands. For example, the operational frequency bands may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US—Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting—handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

The operational frequency bands may include (but are not limited to) any suitable bands. For example, any 5G band or bands. 5G is or is planned to have a frequency range from sub-1 GHz to 71 GHz. For example, any band or bands within the unlicensed band at 60 GHz used for Wireless Gigabit Alliance (WiGig).

An operational resonant frequency band is a frequency band over which an antenna can efficiently operate and is a frequency range where the antenna's return loss is less than (more negative than) an operational threshold.

In the illustrated example, as illustrated in FIGS. 1 to 4, the first lower frequency antenna feed 120 and the first higher frequency antenna feed 130 lie in the same plane, the second plane P2. The at least one higher frequency interface 135 is connected to the first higher frequency antenna feed 130 via an in-plane connector 136 (e.g. 136A or 136B) that passes through a gap 142, in the second plane P2, between outer conductive elements 122 of the first lower frequency antenna feed 120, in the second plane P2. The at least one lower frequency interface 125 is connected to the first lower frequency antenna feed 120 via an in-plane connector 126 (e.g. 126A or 126B).

In the illustrated example, first higher frequency antenna feed 130 is connected to two different higher frequency interfaces 135A, 135B via respective connectors 136A, 136B. One higher frequency interface 135A is associated with a first polarization (+45°) and the other higher frequency interface 135B is associated with a second polarization (−45°), orthogonal to the first polarization. Also the first lower frequency antenna feed 120 is connected to two different lower frequency interfaces 125A, 125B via respective connectors 126A, 126B. One lower frequency interface 125B is associated with the first polarization (+45°) and the other lower frequency interface 125A is associated with a second polarization (−45°), orthogonal to the first polarization.

While in the examples illustrated, the connectors 126A, 126B are in-plane, and lie in and extend with the second plane P2, in other examples they may instead extend through the printed circuit board 54 from below.

While in the examples illustrated, the connectors 136A, 136B are in-plane, and lie in and extend with the second plane P2, in other examples they instead may extend through the printed circuit board 54 from below.

In some examples, the connector(s) 126 and/or the connector(s) 136 extend on one or more planes and utilize "vias" to jump from plane to plane. In some examples one or more connector may extend across two or more planes whilst remaining electrically coupled (galvanically).

In the illustrated example, higher frequency interface 135A for the first polarization is connected to the first higher frequency antenna feed 130 via an in-plane connector 136A that passes through a gap 142, in the second plane P2, between outer conductive elements 122A, 122B of the first lower frequency antenna feed 120, in the second plane P2. The higher frequency interface 135B for the second polarization is connected to the first higher frequency antenna feed 130 via a different in-plane connector 136B that passes through a different gap 142, in the second plane P2, between outer conductive elements 122A, 122B of the first lower frequency antenna feed 120, in the second plane P2.

In order to control performance of the illustrated antenna, the sizes of the following gaps are constrained:

(i) the gap 140 between the exterior (e.g. circular) perimeter of the higher frequency feed 130 and the interior (e.g. circular) perimeter of the lower frequency feed 120;

(ii) the in-plane gap 142 through the lower frequency feed 120 creating a via (through-path) to allow an in-plane connector 136 to access the higher frequency feed 130. (This is the gap 142 between separated parts 122A, 122B of the lower frequency antenna feed 120);

(iii) the in-plane gap 144 between the lower frequency feed at the gap 142 and the in-plane connector 136 to the higher frequency feed. (This is the gap between a separated part 122A, 122B of the lower frequency antenna radiator 120 and the in-plane connector 136).

If we assume a resonant frequency $f_O$ for a radiator, then there is a corresponding 'resonant wavelength' $\lambda_O$, where $c=f_O\ \lambda_O$. The lower frequency antenna radiator 20 has a lower resonant frequency $f_L$ and a corresponding resonant wavelength $\lambda_L$. The higher frequency antenna radiator 30 has a higher resonant frequency $f_H$ and a corresponding resonant wavelength $\lambda_H$.

In some examples, the radiators 20, 30 have a size $\lambda_O/2$ and the feeds 120, 130 have a size smaller than $\lambda_O/2$. The radius of the lower frequency antenna radiator 20 is $\lambda_L/4$, the radius of the higher frequency antenna radiator 30 is $\lambda_H/4$, the radius of the lower frequency feed 120 is less than $\lambda_L/4$ and the radius of the higher frequency feed 130 is less than $\lambda_H/4$.

The distance between the radiator 20; 30 and its corresponding feed 120; 130 is around $\lambda_O/25$. The P2 to P4 distance is around $\lambda_L/25$. The P2 to P3 distance is around $\lambda_H/25$. The P1 to P2 distance depends upon the dielectric constant and the desired microstrip impedance. There is significant design freedom for this distance.

The gap 140 between feeds 120, 130; the gap 142 between parts of the lower frequency feed 120; and the gaps 144 between the in-plane connector 136 for the higher frequency feed 130 and the parts of the lower frequency feed 120 are selected so that the inter-level capacitance between the lower frequency feed and radiator and between the higher frequency feed and radiator is greater than the intra-level capacitance between lower frequency and higher frequency elements.

In some embodiments where the lower frequency feed 120 is annular in shape and continuous (does not have gaps 142, 144), then the feedlines or connectors 126 can be provided to the feed 120 from underneath via another layer of a multilayer PCB/substrate. The feedlines or connectors 136 could be provided to the central higher frequency feed 130 in the same manner.

In the example illustrated, the first lower frequency antenna radiator 20 comprises a single outer conductive element 22 surrounding an interior void 24. The first higher frequency antenna radiator 30 comprises a single interior conductive element 32 surrounded by an exterior void 34. The first higher frequency antenna feed 130 comprises a single interior conductive element 132 surrounded at least partially by an exterior void 134. The first lower frequency antenna feed 120 comprises two outer conductive elements 122A, 122B surrounding at least partially an interior void 124.

The first lower frequency antenna feed 120 and the first higher frequency antenna feed 130 are in the same plane (P2). The first lower frequency antenna radiator 20 and the first higher frequency antenna radiator 30 are in different planes (P4 and P3 respectively).

The single outer conductive element 22 is, in this example, of (substantially) annular shape. Other shapes are possible. The outer conductive elements 122A, 122B are, in this example, parts which are of a (substantially) annular shape. Other shapes are possible.

The single interior conductive element 32 is, in this example, of circular shape. Other shapes are possible. The inner conductive element 132 is, in this example, of a (substantially) circular shape. Other shapes are possible.

The interior void 24 is, in this example, circular and the interior conductive element 32 has, in this example, a circular perimeter. Other shapes are possible. In this example the interior conductive element 32 is centrally positioned with respect to the interior void 24 so that they are, for example, concentric. In this example the interior conductive element 32 is of a smaller size than the interior void 24.

The interior void 124 is, in this example, circular and the interior conductive element 132 is circular. Other shapes are possible. In this example the interior conductive element 132 is centrally positioned with respect to the interior void 124 so that they are, for example, concentric. In this example the interior conductive element 132 is of a smaller size than the interior void 124.

The interior conductive element 32 is centrally positioned with respect to the interior conductive element 132 so that they are, for example, concentric. In this example the interior conductive element 132 is of the same or similar size to the interior conductive element 32.

The outer conductive element 22 is centrally positioned with respect to the outer conductive element 122 so that they are, for example, concentric. In this example the outer conductive element 122 is of the same or similar size to the outer conductive element 122.

The ground plane 60 is a conductive element that has an area that entirely overlaps the first lower frequency antenna radiator 20 and the first lower frequency feed 120.

The lower frequency interface(s) 125 for the first lower frequency feed 120 is a connection interface at which the antenna 10 is connectable to a lower frequency port of radio frequency circuitry. The higher frequency interface(s) 135 for the first higher frequency feed 130 is a connection interface at which the antenna 10 is connectable to a higher frequency port of radio frequency circuitry.

Figure 5:
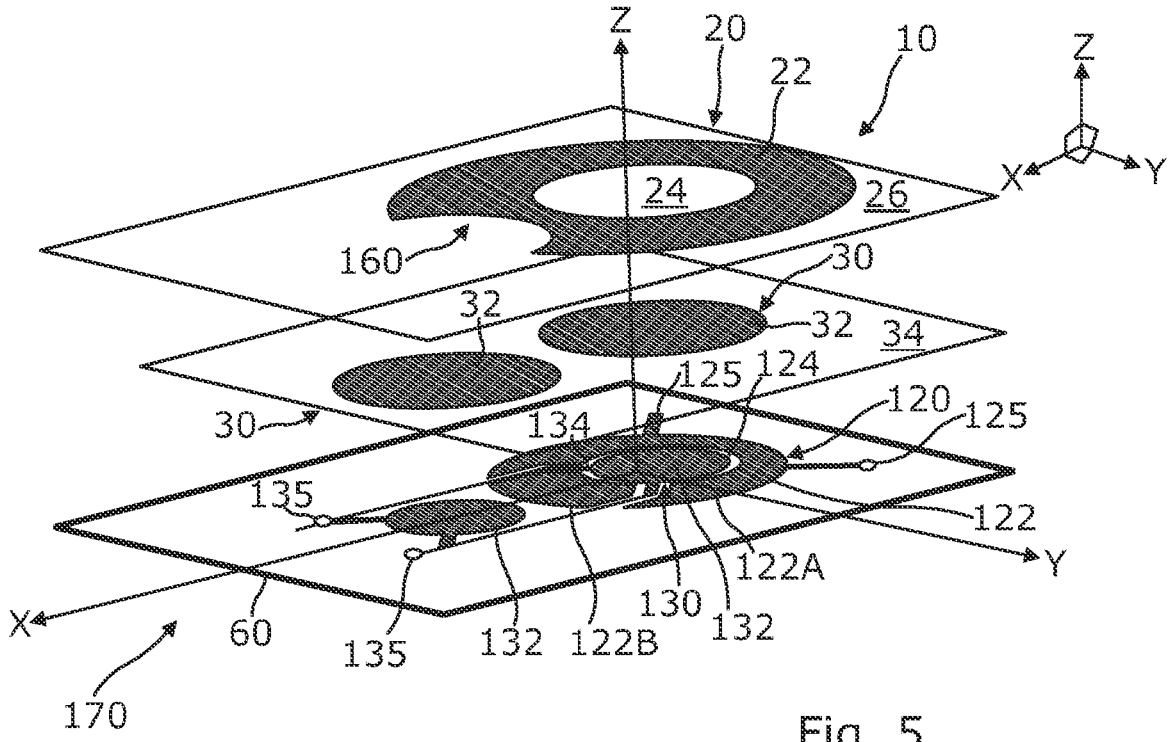
FIG. 5 shows an example embodiment of the subject matter described herein.
Figure 6:
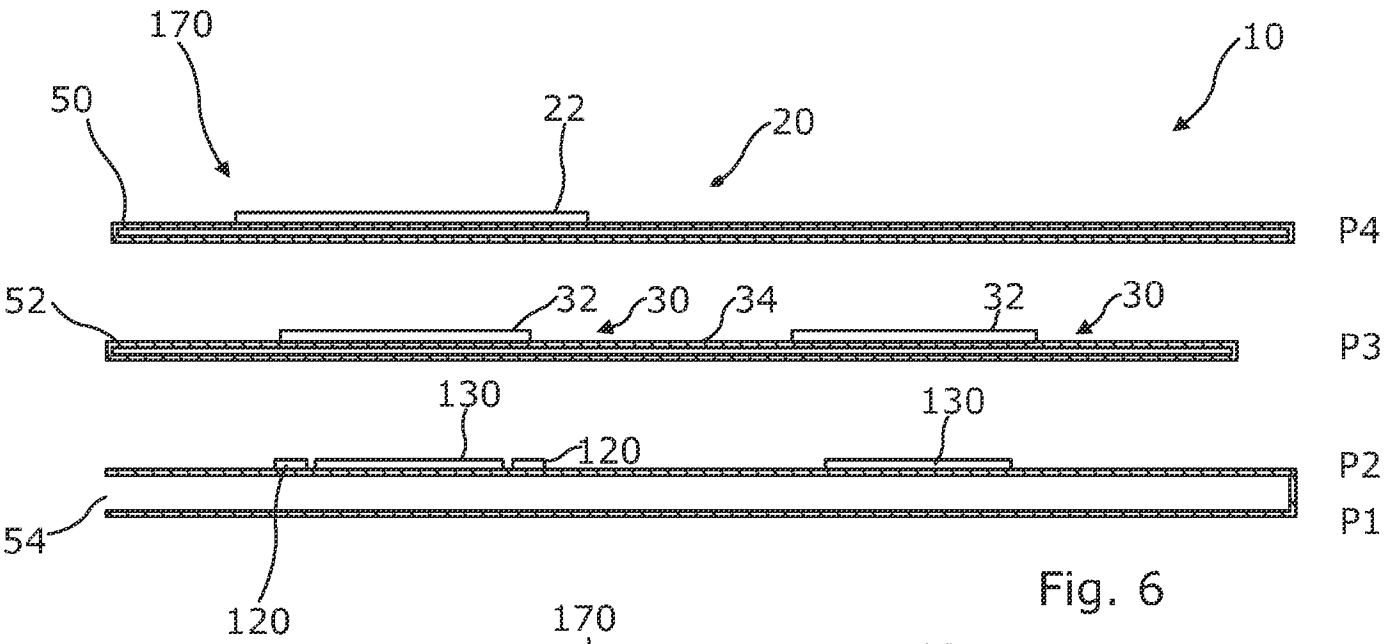
FIG. 6 shows an example embodiment of the subject matter described herein.

FIGS. 5 and 6 illustrate an example of the multi-band antenna 10 previously described. The previous description is also a description of this multi-band antenna 10. FIG. 5 is equivalent to FIG. 1. FIG. 6 is equivalent to FIG. 4.

In this example, the perimeter of the lower frequency antenna radiator 20 is not wholly circular but is partially circular. The perimeter of the lower frequency antenna radiator 20 has a shaped void 160 (it is a bite or curved cut-away at the edge e.g. a scallop) from a circular shape, to avoid overlap with a second higher frequency antenna radiator 30.

The first higher frequency antenna radiator 30 and the second higher frequency antenna radiator 30 are in the same plane. The first higher frequency antenna radiator 30 overlaps with the interior void 24 of the first lower frequency antenna radiator 20 but not the conductive element 22 of the first lower frequency antenna radiator 22. The second higher frequency antenna radiator 30 overlaps with the shaped void (bite) 160 of the first lower frequency antenna radiator 20 but not the conductive element 22 of the first lower frequency antenna radiator 22.

The first higher frequency antenna radiator 30 overlaps with a conductive element 132 of the first lower frequency feed 130 as previously described. Similarly, the second higher frequency antenna radiator 30 overlaps with a conductive element 132 of a second lower frequency feed 130.

Consequently, the one or more outer conductive elements 22 of the first lower frequency antenna radiator 20 are shaped to provide a shaped exterior void 160. The second higher frequency antenna radiator 30 comprising one or more interior conductive elements 32 is surrounded by an exterior void 34. The one or more interior conductive elements 32 of the second lower frequency antenna radiator 30 overlap the shaped exterior void 160 of the first lower frequency antenna radiator 20 and do not overlap the one or more outer conductive elements 22 of the first lower frequency antenna radiator 20.

The first higher frequency feed 130 and the second higher frequency feed lie in the same plane. The first higher frequency feed 130 is at least partially surrounded by the outer conductive element(s) 122 of the first lower frequency antenna feed 120. The second higher frequency feed 130 is not surrounded by outer conductive element(s) 122 of a lower frequency antenna feed 120.

The arrangement illustrated in FIG. 5 represents a multiband antenna that has a single lower frequency antenna radiator 20 associated with a single lower frequency feed 120 and has a pair of higher frequency antenna radiators 30 associated with a pair of higher frequency feeds 130. The pair of higher frequency feeds 130 are connected in electrical parallel.

Figure 7:
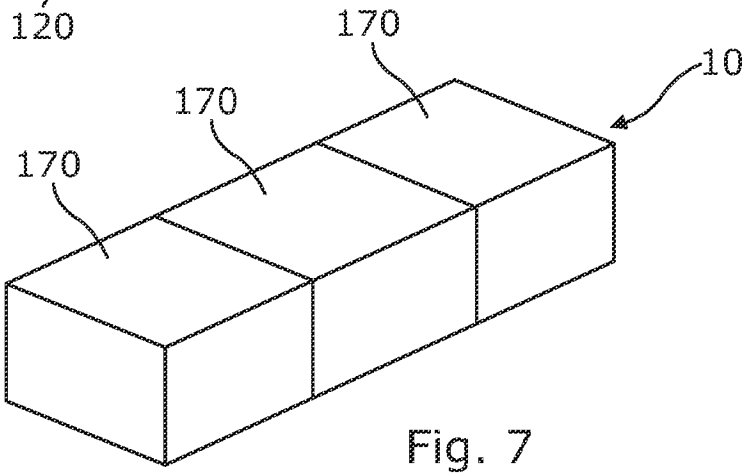
FIG. 7 shows an example embodiment of the subject matter described herein.

The arrangement illustrated in FIGS. 5 and 6 represents a cell 170 that can be tessellated within the planes P, for example as illustrated in FIG. 7. The cell 170 may be tessellated N times in the x-direction and/or M times in the y-direction to create a N×M array of lower frequency antenna radiators 20 associated with a N×M array of lower frequency feeds 120 and to create a 2N×M array of higher frequency antenna radiators 30 associated with a 2N×M array of higher frequency feeds 130. The lower frequency feeds 120 are connected in electrical parallel to the lower frequency interface(s) 125. The higher frequency feeds 130 are connected in electrical parallel to the higher frequency interface(s) 135.

Thus in some examples, the dual-band antenna 10 comprises: an array of lower frequency antenna radiators 20, including the first lower frequency antenna radiator, in a common plane P4; an array of lower frequency antenna feeds 120, including the first lower frequency antenna feed, in a common plane P2; an array of higher frequency antenna radiators 30, including the first higher frequency antenna radiator, in a different common plane P3; and an array of higher frequency antenna feeds, including the first higher frequency antenna feed, in a common plane e.g. P2. The at least one lower frequency interface 125 is for the array of lower frequency feeds and the at least one higher frequency interface 135 is for the array of higher frequency feeds. A ground plane 60 overlaps the arrays of radiators 20, 30.

The array of lower frequency antenna radiators 20 comprises multiple outer conductive elements 22 surrounding multiple interior voids 24 and surrounded by an exterior void 26 including the shaped void 160. The array of higher frequency antenna radiators 30 comprises multiple interior conductive elements 32 surrounded by an exterior void 34. The multiple interior conductive elements 32 of the array of higher frequency antenna radiators 30 and the multiple outer conductive elements 22 of the array of lower frequency antenna radiators 20 do not overlap. At least some of the multiple interior conductive elements 32 of the array of higher frequency antenna radiators 30 overlap the multiple interior voids 24 of the array of lower frequency antenna radiators 20, and the other multiple interior conductive elements 32 of the array of higher frequency antenna radiators 30 overlap the exterior void 26, 160 of the array of lower frequency antenna radiators 20.

Referring back to FIGS. 4 and 6, it should be recognized that the printed circuit boards 50, 52, 54 may be provided separately (50; 52; 54), in pairwise combinations (50 & 52 or 52 & 54) or as a triplet combination (50 & 52 & 54).

The printed circuit board 54 provides a planar feed for a multi-band antenna 10 comprising:

- a first lower frequency antenna feed 120 comprising, in a plane P2, one or more outer conductive elements 122 surrounding at least partially an interior void 124;
- a first higher frequency antenna feed 130 comprising, in the plane P2, one or more interior conductive elements 132 surrounded at least partially by the interior void 124;
- and at least one lower frequency interface 125 and at least one higher frequency interface 135, wherein the at least one lower frequency interface 125 is for the first lower frequency feed 120 and the at least one higher frequency interface 135 is for the first higher frequency feed 130.

The printed circuit board 54 can also provide a ground plane 60 for a multi-band antenna 10 in a different plane P1.

In some examples, the ground plane 60 is on the same plane P2 as the feeds 120, 130, where the ground plane 60 covers a majority of the layer P2 (relative to the area used for the feeds 120, 130 and feedlines 126, 136) but is not in direct galvanic connection to the feeds 120, 136 or feedlines 126, 136.

The ground plane 60 could also alternatively be provided by a metal sheet, separate to the substrate (making the substrate thinner), either as a separate component or as part of a cover/housing of a piece of radio communications apparatus.

Figure 8:
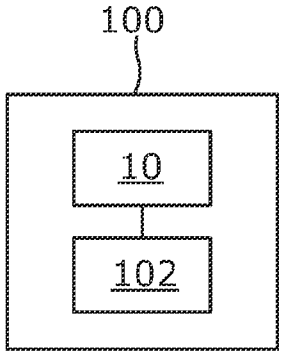
FIG. 8 shows an example embodiment of the subject matter described herein.

FIG. 8 illustrates an example of a communications apparatus 100 comprising radio frequency circuitry 102 and the multi-band antenna 10. The radio frequency circuitry 102 can, for example, be receiver circuitry for receiving radio frequency signals via the multi-band antenna 10, transmitter circuitry for transmitting radio frequency signals via the multi-band antenna 10, or transceiver circuitry for receiving and/or transmitting radio frequency signals via the multi-band antenna 10.

In some but not necessarily all examples, the communications apparatus 100 is a compact, hand-portable device that is sized to be held in a palm of one hand while operated by the other hand. It may be sized to fit in a handbag or jacket pocket.

In some but not necessarily all examples, the communications apparatus 100 is a node in a telecommunications network. The telecommunications network may, for example, be a cellular telecommunications network. The telecommunications network may, for example, support a distributed network such as the Internet of things.

As used in this application, the term 'circuitry' may refer to one or more or all of the following:

(a) hardware-only circuitry implementations (such as implementations in only analog and/or digital circuitry) and (b) combinations of hardware circuits and software, such as (as applicable):

(i) a combination of analog and/or digital hardware circuit (s) with software/firmware and (ii) any portions of hardware processor(s) with software (including digital signal processor(s)), software, and memory(ies) that work together to cause an apparatus, such as a mobile phone or server, to perform various functions and (c) hardware circuit(s) and or processor(s), such as a microprocessor(s) or a portion of a microprocessor(s), that requires software (e.g. firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor and its (or their) accompanying software and/or firmware. The term circuitry also covers, for example and if applicable to the particular claim element, a baseband integrated circuit for a mobile device or a similar integrated circuit in a server, a cellular network device, or other computing or network device.

Figure 9A:
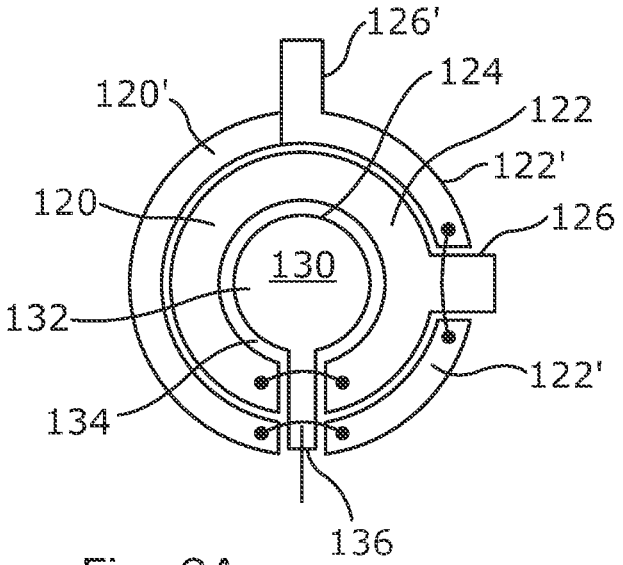
FIG. 9A shows an example embodiment of the subject matter described herein.
Figure 9B:
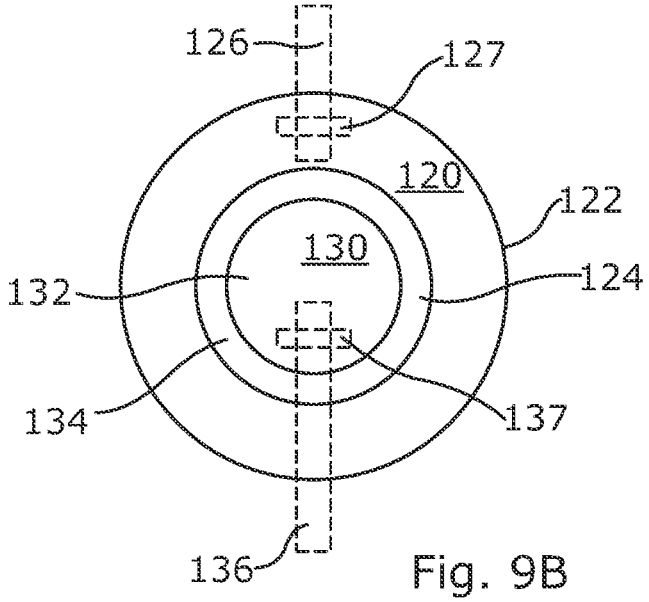
FIG. 9B shows an example embodiment of the subject matter described herein.
Figure 9C:
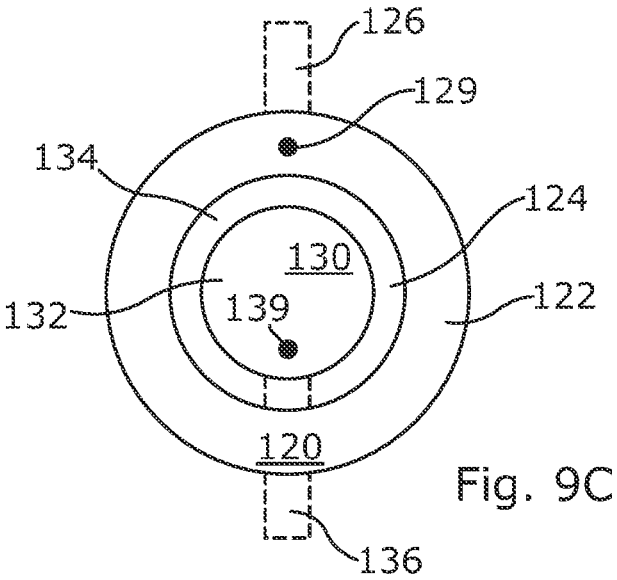
FIG. 9C shows an example embodiment of the subject matter described herein.

Additional examples of an inter-relationship of the first lower frequency antenna feed 120 and the first higher frequency antenna feed 130 are illustrated in FIGS. 9A, 9B and 9C. The first lower frequency antenna feed 120 comprises one or more outer conductive elements 122 surrounding at least partially an interior void 124. The first higher frequency antenna feed 130 comprises one or more interior conductive elements 132 surrounded at least partially by an exterior void 134.

FIG. 9A illustrates a feed arrangement for a multi-band antenna 10. The multi-band antenna is a tri-band antenna that has three operational frequency bands F1, F2, F3.

Each operational frequency band is associated with a different antenna feed. The first lower frequency antenna feed 120 is associated with the frequency band F2.

The first higher frequency antenna feed 130 is associated with the higher frequency band F3. A further lower frequency antenna feed 130' is associated with a lower frequency band F1. The first higher frequency antenna feed 130, the first lower frequency antenna feed 120 and the further lower frequency antenna feed 130' lie in the same plane and are connected to respective interfaces via respective in-plane connectors 136, 126, 126'. The in-plane connector 136 to the first higher frequency antenna feed 130 passes through a gap between portions of the conductive elements 122 of the lower frequency antenna feed 120 and between portions of the conductive elements 122' of the further lower frequency antenna feed 120'. The in-plane connector 126 to the first lower frequency antenna feed 120 passes through a gap (same or different to the gap for the connector 136) between portions of the conductive elements 122' of the further lower frequency antenna feed 120'.

In this example, and in other described examples, the portions of the conductive elements 122 of the first lower frequency antenna feed 120 separated by a gap can be interconnected by a conductive interconnect. In this example, and in other described examples, the portions of the conductive elements 122' of the further lower frequency antenna feed 120' separated by gaps can be interconnected by a conductive interconnect.

FIG. 9B illustrates a feed arrangement for a multi-band antenna 10. The multi-band antenna is a dual-band antenna that has two operational frequency bands as previously described. The first higher frequency antenna feed 130 and the first lower frequency antenna feed 120 have respective conductive element(s) 132, 122 that lie in the same plane. The first higher frequency antenna feed 130 and the first lower frequency antenna feed 120 are coupled to respective interfaces via respective connectors 136, 126. The connectors 136, 126 are not in the same plane as the conductive element(s) 122, 132 of the first higher frequency antenna feed 130 and the first lower frequency antenna feed 120. The connectors 136, 126 are in a common plane that is offset from the plane of the conductive element(s) 122, 132 of the first higher frequency antenna feed 130 and the first lower frequency antenna feed 120. A slot 127 is used to couple the connector 126 to the conductive element(s) 122 of the first lower frequency antenna feed 120. The slot 127 is formed in a conductive layer, between the conductive element(s) 122 and the connector 126, that is connected as a common ground. A slot 137 is used to couple the connector 136 to the conductive element(s) 132 of the first higher frequency antenna feed 130. The slot 137 is formed in a conductive layer, between the conductive element(s) 132 and the connector 136, that is connected as a common ground.

FIG. 9C illustrates a feed arrangement for a multi-band antenna 10. The multi-band antenna is a dual-band antenna that has two operational frequency bands as previously described. The first higher frequency antenna feed 130 and the first lower frequency antenna feed 120 have respective conductive element(s) 132, 122 that lie in the same plane. The first higher frequency antenna feed 130 and the first lower frequency antenna feed 120 are interconnected to respective interfaces via respective connectors 136, 126. The connectors 136, 126 are not entirely in the same plane as the conductive element(s) 122, 132 of the first higher frequency antenna feed 130 and the first lower frequency antenna feed 120. The connectors 136, 126 are at least partially in a common plane that is offset from the plane of the conductive element(s) 122, 132 of the first higher frequency antenna feed 130 and the first lower frequency antenna feed 120. The connector 126 extends between the different planes, through a via 129, to the conductive element(s) 122 of the first lower frequency antenna feed 120. The via 129 is through a substrate that supports the conductive element(s) 122 of the first lower frequency antenna feed 120. The connector 136 extends between the different planes, through a via 139, to the conductive element(s) 132 of the first higher frequency antenna feed 130. The via 139 is through a substrate that supports the conductive element(s) 132 of the first higher frequency antenna feed 130. The vias 129, 139 are made from a conductive material to provide a galvanic electrical connection between different layers of the substrate/PCB.

Where a structural feature has been described, it may be replaced by means for performing one or more of the functions of the structural feature whether that function or those functions are explicitly or implicitly described.

The radiators 20, 30 can have different shapes to each other and can have different shapes to those described above. For example, they may be square or rectangular. The feeds 120, 130 can have different polarization(s) to each other and different polarization(s) to those described above. The radiators 20, 30 can be made of metal such as aluminum and the layers between the planes can be air or plastic.

As used here 'module' refers to a unit or apparatus that excludes certain parts/components that would be added by an end manufacturer or a user. The antenna 10 may be a module. The circuit board 54 may be a module.

The above described examples find application as enabling components of:

automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one." or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

That which is claimed is:

1. A multi-band antenna comprising:

a ground plane;

a first lower frequency antenna radiator comprising one or more outer conductive elements surrounding an interior void;

a first higher frequency antenna radiator comprising one or more interior conductive elements surrounded by an exterior void;

a first lower frequency antenna feed comprising one or more outer conductive elements surrounding at least partially an interior void;

a first higher frequency antenna feed disposed on a same plane as the first lower frequency antenna feed comprising one or more interior conductive elements surrounded at least partially by an exterior void; and at least one lower frequency interface and at least one higher frequency interface, wherein the at least one lower frequency interface is for the first lower frequency antenna feed and the at least one higher frequency interface is for the higher frequency antenna feed.

2. A multi-band antenna as claimed in claim 1, wherein the one or more interior conductive elements of the first higher frequency antenna feed overlap the interior void of the first lower frequency antenna feed.

3. A multi-band antenna as claimed in claim 1, wherein the one or more interior conductive elements of the first higher frequency antenna feed are surrounded at least partially by the one or more outer conductive elements of the first lower frequency antenna feed and are separated therefrom by a portion of the interior void of the first lower frequency antenna feed that is also at least part of the exterior void of the first higher frequency antenna feed.

4. A multi-band antenna as claimed in claim 1, wherein a first printed circuit board provides the ground plane, the first lower frequency antenna feed, and the first higher frequency antenna feed, a second printed circuit board different to the first printed circuit board provides the first higher frequency antenna radiator, and a third printed circuit board, different to the first printed circuit board and the second printed circuit board, provides the first lower frequency antenna radiator.

5. A multi-band antenna as claimed in claim 1, wherein the first lower frequency antenna feed and the first higher frequency antenna feed lie in the same plane and wherein the at least one higher frequency interface is connected to the first higher frequency antenna feed via an in-plane connector that passes through a gap between outer conductive elements of the first lower frequency antenna feed.

6. A multi-band antenna as claimed in claim 1, wherein the one or more outer conductive elements of the first lower frequency antenna radiator are in a first plane and the one or more interior conductive elements of the first higher frequency antenna radiator are in a second plane different to the first plane and the second plane is further from the ground plane than the first plane.

7. A multi-band antenna as claimed in claim 1, wherein the one or more outer conductive elements of the lower frequency antenna radiator, surrounded by an exterior void, define a shape that has exterior dimensions sized to cause resonance at the lower frequency.

8. A multi-band antenna as claimed in claim 1, wherein the interior void of the lower frequency antenna radiator is circular.

9. A multi-band antenna as claimed in claim 1, wherein a perimeter of the lower frequency antenna radiator is at least partially circular and/or wherein a perimeter of the lower frequency antenna radiator has cut-away at an edge to avoid overlap with a second higher frequency antenna radiator.

10. A multi-band antenna as claimed in claim 1, wherein the one or more outer conductive elements of the first lower frequency antenna radiator are shaped to provide an exterior void, a second higher frequency antenna radiator comprising one or more interior conductive elements surrounded by an exterior void, wherein the one or more interior conductive elements of the second lower frequency antenna radiator overlap the shaped exterior void of the first lower frequency antenna radiator and do not overlap the one or more outer conductive elements of the first lower frequency antenna radiator.

11. A multi-band antenna as claimed in claim 1, comprising:

an array of lower frequency antenna radiators, including the first lower frequency antenna radiator, in a common plane;

an array of lower frequency antenna feeds, including the first lower frequency antenna feed;

an array of higher frequency antenna radiators, including the first higher frequency antenna radiator, in a different common plane; and an array of higher frequency antenna feeds, including the first higher frequency antenna feed, wherein the at least one lower frequency interface is for the array of lower frequency feeds and the at least one higher frequency interface is for the array of higher frequency feeds.

12. A multi-band antenna as claimed in claim 11, wherein the array of lower frequency antenna radiators comprises multiple outer conductive elements surrounding multiple interior voids and surrounded by an exterior void, wherein the array of higher frequency antenna radiators comprises multiple interior conductive elements surrounded by an exterior void, wherein the multiple interior conductive elements of the array of higher frequency antenna radiators and the multiple outer conductive elements of the array of lower frequency antenna radiators do not overlap, and wherein at least some of the multiple interior conductive elements of the array of higher frequency antenna radiators overlap the multiple interior voids of the array of lower frequency antenna radiators, wherein the other multiple interior conductive elements of the array of higher frequency antenna radiators overlap the exterior void of the array of lower frequency antenna radiators.

13. A planar feed for a multi-band antenna comprising:

a first lower frequency antenna feed comprising, in a plane, one or more outer conductive elements surrounding at least partially an interior void;

a first higher frequency antenna feed comprising, in the plane, one or more interior conductive elements surrounded at least partially by the interior void, wherein the first lower frequency antenna feed and first higher frequency antenna feed are disposed on the same plane; and at least one lower frequency interface and at least one higher frequency interface, wherein the at least one lower frequency interface is for the first lower frequency antenna feed and the at least one higher frequency interface is for the first higher frequency antenna feed.

14. A planar feed as claimed in claim 13, wherein the one or more interior conductive elements of the first higher frequency antenna feed overlap the interior void of the first lower frequency antenna feed.

15. A planar feed as claimed in claim 13, wherein the one or more interior conductive elements of the first higher frequency antenna feed are surrounded at least partially by the one or more outer conductive elements of the first lower frequency antenna feed and are separated therefrom by a portion of the interior void of the first lower frequency antenna feed.

16. A planar feed as claimed in claim 13, wherein the first lower frequency antenna feed and the first higher frequency antenna feed lie in the same plane and wherein the at least one higher frequency interface is connected to the first higher frequency antenna feed via an in-plane connector that passes through a gap between outer conductive elements of the first lower frequency antenna feed.

17. A communications apparatus comprising:

radio frequency circuitry; and a multi-band antenna comprising:

a ground plane;

a first lower frequency antenna radiator comprising one or more outer conductive elements surrounding an interior void;

a first higher frequency antenna radiator comprising one or more interior conductive elements surrounded by an exterior void;

a first lower frequency antenna feed comprising one or more outer conductive elements surrounding at least partially an interior void;

a first higher frequency antenna feed disposed on a same plane as the first lower frequency antenna feed comprising one or more interior conductive elements surrounded at least partially by an exterior void; and at least one lower frequency interface and at least one higher frequency interface, wherein the at least one lower frequency interface is for the first lower frequency antenna feed and the at least one higher frequency interface is for the higher frequency antenna feed.

18. A communications apparatus as claimed in claim 17, wherein the one or more interior conductive elements of the first higher frequency antenna radiator overlap the interior void of the first lower frequency antenna radiator and do not overlap the one or more outer conductive elements of the first lower frequency antenna radiator.

19. A communications apparatus as claimed in claim 17, wherein the one or more outer conductive elements of the first lower frequency antenna radiator are shaped to provide an exterior void, wherein the multi-band antenna further comprises a second higher frequency antenna radiator comprising one or more interior conductive elements surrounded by an exterior void, wherein the one or more interior conductive elements of the second lower frequency antenna radiator overlap the shaped exterior void of the first lower frequency antenna radiator and do not overlap the one or more outer conductive elements of the first lower frequency antenna radiator.

20. A communications apparatus as claimed in claim 17, wherein the one or more outer conductive elements of the first lower frequency antenna radiator are in a first plane and the one or more interior conductive elements of the first higher frequency antenna radiator are in a second plane different to the first plane and the second plane is further from the ground plane than the first plane.

* * * * *